United States Patent [19]

Hogg et al.

[11] 4,146,128

[45] Mar. 27, 1979

[54] SEPARABLE PACKAGE

[75] Inventors: John W. Hogg, Benton Harbor, Mich.; G. Norman Heaton, Elkhart, Ind.

[73] Assignee: Shepherd Products U.S. Inc., St. Joseph, Mich.

[21] Appl. No.: 867,383

[22] Filed: Jan. 6, 1978

Related U.S. Application Data

[63] Continuation-in-part of Ser. No. 724,606, Sep. 20, 1976, abandoned.

[51] Int. Cl.[2] ..... B65D 5/50; B65D 25/54; B65D 85/58

[52] U.S. Cl. ..... 206/45.19; 206/45.34; 206/318; 206/470; 206/806; 229/9

[58] Field of Search ..... 206/45.14, 45.19, 45.34, 206/318, 470, 806; 229/9, 19, 10, 11, 20

[56] References Cited

U.S. PATENT DOCUMENTS

| | | | |
|---|---|---|---|
| 1,899,547 | 2/1933 | Addis et al. | 206/45.14 |
| 2,157,954 | 5/1939 | Gould | 206/45.14 |
| 2,162,089 | 6/1939 | Kasen | 206/45.31 X |
| 2,778,487 | 1/1957 | Raeburn | 206/45.19 |
| 3,168,952 | 2/1965 | Palmer | 206/45.34 X |
| 3,236,435 | 2/1966 | Nichols | 206/45.34 X |
| 3,298,504 | 1/1967 | Carter | 206/45.14 |
| 3,302,843 | 2/1967 | Sheehan | 206/491 X |
| 3,334,734 | 8/1967 | Meyers | 206/45.14 |
| 3,370,697 | 2/1968 | Levey et al. | 206/45.34 |
| 3,448,853 | 6/1969 | Repko | 206/470 |
| 3,670,881 | 6/1972 | Dutcher | 206/45.34 |
| 3,690,902 | 9/1972 | Dahl | 426/115 |
| 3,759,720 | 9/1973 | Young | 229/9 X |
| 3,900,104 | 8/1975 | Harned | 229/9 X |
| 3,985,232 | 10/1976 | Johnson | 206/461 |

*Primary Examiner*—William Price
*Assistant Examiner*—Allan N. Shoap
*Attorney, Agent, or Firm*—McWilliams, Mann & Zummer

[57] ABSTRACT

A two-part package formed from separate blanks each foldable to provide respective package elements of box like shape with one element slidable into the other to complete a combined unit having a front window opening to reveal part of a contents contained in a clear plastic blister unit and side window openings formed by aligned openings in the respective package elements to reveal additional contents in the blister unit. Closure tabs are provided on one package element for access to the contents through the top of this element and a perforated hanging tab is provided on this element for suspending the combined package elements in a display position. The blister enclosed contents may be disposed in the package for ready removal by sliding this element as a container of the contents, out of the package element whereby the blister becomes the separate package element for holding the contents and which is inserted and removed from the package as a fully loaded container.

4 Claims, 13 Drawing Figures

39
44
71
65
19
67
14
25
17
73
18
13
76
24
74
77
54
52
58
26
56
33
32
11
22
47
37
75
61
12
45

SEPARABLE PACKAGE

This application is a continuation-in-part of our application Ser. No. 724,606, filed Sept. 20, 1976, now abandoned.

BACKGROUND OF THE INVENTION

Heretofore, it has been common practice to enclose merchandise, such as furniture casters, in a carton, or cardboard box, wherein the contents were accessible through a hinged flap insertable at one end, or by means of pairs of overlapping cover portions hinged at right angles which were secured in closed positions by staples, or the like, or by gluing the outermost flap portions onto the inner portions, or by taping these cover portions down so that the contents were securely held in closely confined position. In any event, the contents were not visible, or accessible for examination without opening the package or at least partially destroying the sealed condition of the package. Visible display packages have been provided in some prior art devices but these have been sealed packages with covered window openings and made no provision for withdrawing the contents from a carton for examination without breaking the sealed condition or destroying the package. None has provided a separable package arrangement where the contents can be withdrawn from one carton element while contained in a second element which enables the contents to be examined fully and then reinserted into the one carton element and the closure restored without disrupting the packaged condition of the contents in any way. Cartons have been provided which can be opened to remove the contents but in these the contents was not contained in a viewing type of carton slidable out of the first enclosing carton for examination while remaining intact in packaged condition but were loose and necessitated reinsertion into the carton piece by piece which disturbed the original packaged arrangement.

SUMMARY OF THE INVENTION

The present invention provides a package for furniture casters, or the like, which prepackages a set of four casters and makes all four casters visible in the final packaged condition to check the actual number of casters in the package without the necessity for opening any part of the carton arrangement comprising the package. Further, this package arrangement enables withdrawal of the set of four casters from the package without disrupting the carton and after examination the set of casters can be reinserted into the package and the closed condition of the carton restored, all without disturbing the original containment of the casters as a set of four.

The packaging arrangement of this invention includes an enclosing carton which can be opened at one end for access thereto and reclosed to restore the packaged condition. The enclosing carton includes a viewing window in its face and a viewing window in each of two opposite side wall portions. An inner, or second carton, may be inserted into the enclosing carton through the opened end thereof and the face of this inner carton is entirely open so that the contents disposed in the inner carton can be viewed through the window in the face of the enclosing carton, when the second carton containing the set of four casters is inserted into the first carton. The inner carton also has a viewing window in each of its two side walls and which are aligned with the similar viewing windows in the opposite side walls of the enclosing carton so that the upper pair of casters contained in the inner carton can be checked through these window openings while the bottom pair of casters can be viewed through the window opening provided in the face of the carton.

The set of four casters are contained in a plastic blister element in the carton and which may be open at its backside so that while the front of the contents is thus protected by the blister and prevented from escaping from the package through the front window opening, the casters can be removed conveniently through the open backside of the blister upon withdrawal of the blister from the carton, as when it becomes desirable to remove casters for use, but are fully protected thereby at all times while the casters are contained in the blister inserted in the carton. Further, the plastic blister serves to maintain the four casters in their individual positions in the package by reason of the shaping and fitting of the blister to the several casters and thereby holds the casters in proper positions both for packaging and for viewing.

The enclosing carton in addition to closing flaps for the open end thereof also is provided with a perforated tab at this same end of the carton whereby the carton may be suspended for display purposes, or it may stand on its bottom end for this same purpose, as on a shelf or a counter top. The plastic blister in one form is provided with an internal flange along one vertical side which is adapted to be confined under an overlying flange provided on a side wall of the inner carton. In a second form, the blister element comprises the container for the casters and the blister with the casters is inserted and removed from the package as a unit. This blister is retained in the package by full height flanges that frictionally engage the interior surfaces of the carton to hold the blister unit in the package. The blister flanges are also flared to increase the frictional contact with the interior of the carton. Thus, the plastic blister is retained in place and the casters are maintained in their respective positions when the casters are moved through the open end of the enclosing carton. Both the inner carton, where used and the enclosing carton are formed from blanks cut and shaped to provide the desired box-like form of the package when the blanks are folded to form the respective cartons.

OBJECTS OF THE INVENTION

It is the primary purpose of this invention to provide a packaging device comprised of separable cartons formed from two blanks folded to provide box-like elements having one such element contained in the other in their combined form and slidable out of the enclosing element through one end thereof for removal of the contents and having a clear plastic enclosure for the contents secured to the inner carton element.

The principal object of the invention is the provision of a multi-part packaging carton comprised of an inner carton and an enclosing carton and having a clear plastic enclosure for a contents, secured to the inner carton.

An important object of the invention is to provide a multi-part packaging device including an enclosing carton having a front window opening and a pair of opposite side window openings and an inner carton having an open front and a pair of side window openings aligned with the respective opposite side window openings in the enclosing cartons.

Another object of the invention is the provision of a multi-part packaging device comprised of an enclosing carton having a front window opening, an inner carton having an open front and a clear plastic enclosure secured to the inner carton for covering a contents at such window opening and to position such contents in the package.

A further object of the invention is to provide a multi-part packaging device comprised of relatively slideable inner carton and outer enclosing carton having aligned openings in the front and sides of the cartons and a clear plastic enclosure for confining a contents and viewing thereof through such openings.

A still further object of the invention is the provision of a multi-part packaging device comprised of relatively slidable inner and outer cartons wherein the inner carton is removable from the outer carton through an end opening and having a clear plastic enclosure secured to the inner carton for covering a contents carried by the inner carton.

A further object of the invention is to provide a blister element which acts as a container for the carton contents where by need for an inner carton is avoided and which blister element includes flanges of a height frictionally to engage the interior of a carton edgewise and which are flared further to engage the carton interior to hold the blister and contents in the carton.

DESCRIPTION OF THE DRAWINGS

The foregoing and other and more specific objects of the invention are attained by the structure and arrangement illustrated in the accompanying drawings, wherein.

DESCRIPTION OF THE PREFERRED EMBODIMENT

Figure 1:
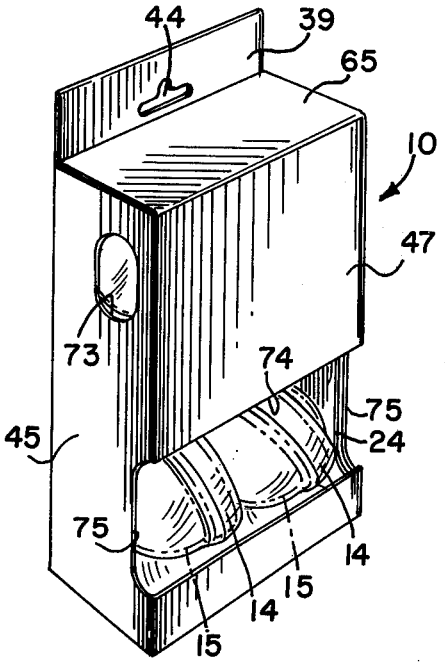
FIG. 1 is a general perspective view of the assembled carton in fully closed condition.
Figure 2:
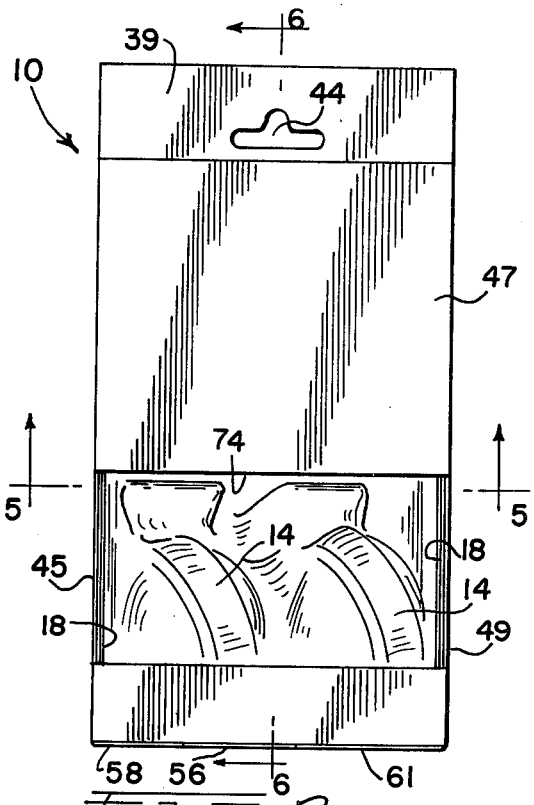
FIG. 2 is a front elevational view of the carton assembly to larger scale than shown in FIG. 1.
Figure 3:
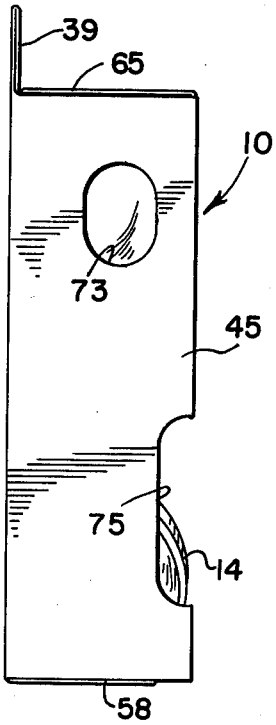
FIG. 3 is a side elevational view of the carton assembly.
Figure 4:
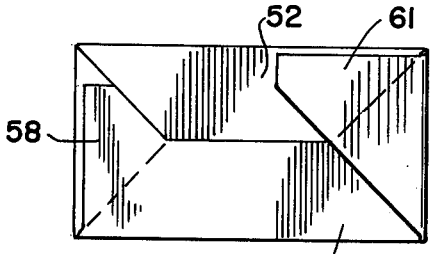
FIG. 4 is a bottom elevational view of the completed carton.

In the drawing 10 represents a carton assembly that is comprised of two basic carton parts consisting of an inner carton 11 and an outer, or enclosing carton 12, but also includes an inner blister enclosure 13 for a contents, which in this instance comprises four planet type casters for furniture, cabinets, or the like. All three of these carton elements are best illustrated in the exploded perspective view of FIG. 7. It will be noted that the blister enclosure 13 has four shaped integral compartments 14 closely contoured to the typical shape of the now common planet type spherical furniture casters. Casters 15 of this type are indicated by phantom lines in FIG. 1 and the carton assembly of this invention is specifically applicable to packaging a set of four of these casters. The casters are thus confined in the carton and prevented from being dislodged from their positions in the package so that they are always positioned properly so long as the integrity of the package is not disturbed.

Figure 9:
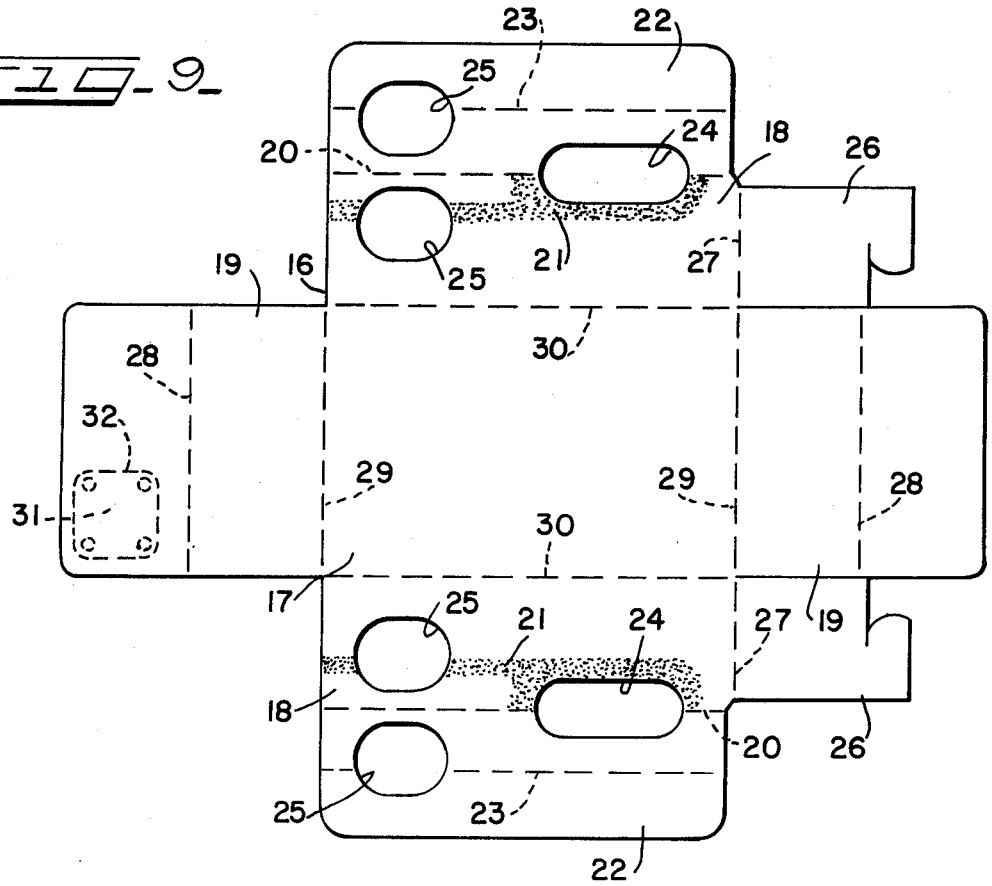
FIG. 9 is a view of the blank for the inner carton element also showing the fold lines and the score lines by dotten iines.

The blister enclosure 13 is mounted in the inner carton 11, which is of open face design so that the blister comprises the only means retaining the four casters in the package. The open faced carton 11 is formed from a blank 16, see FIG. 9, and includes a rear wall 17, side walls 18 and end walls 19. The side walls 18 are folded back upon themselves along fold lines 20 to form walls of double thickness and a suitable cement 21 secures the side wall portions in folded positions. It will be noted that the cement 21 is applied only between a portion of the overlapping side wall portions so that an overlying flange 22 on each side wall is left free of securement from the score line 23 to the free edge thereof. The side walls 18 are each provided with a cutout 24 and window openings 25 for a purpose hereinafter to appear. Each of the side walls is provided at one end with a slotted end tab 26 foldable along fold line 27.

The end walls 19 are foldable back upon themselves along fold lines 28 to provide double thickness end walls which are foldable along fold lines 29 to positions perpendicular to the base rear wall 17 while the double thickness side walls are foldable along fold lines 30 to similar positions perpendicular to the rear wall 17 to form the open face carton of box-like form. When the side walls 18 and the end walls 19 are disposed in their perpendicular positions the slotted end tabs 26 are then folded along the fold lines 27 to positions behind the one end wall where they are interengaged by means of the slotted tab so that when thus secured they serve to maintain the perpendicular positions of the end and side walls.

Figure 5:
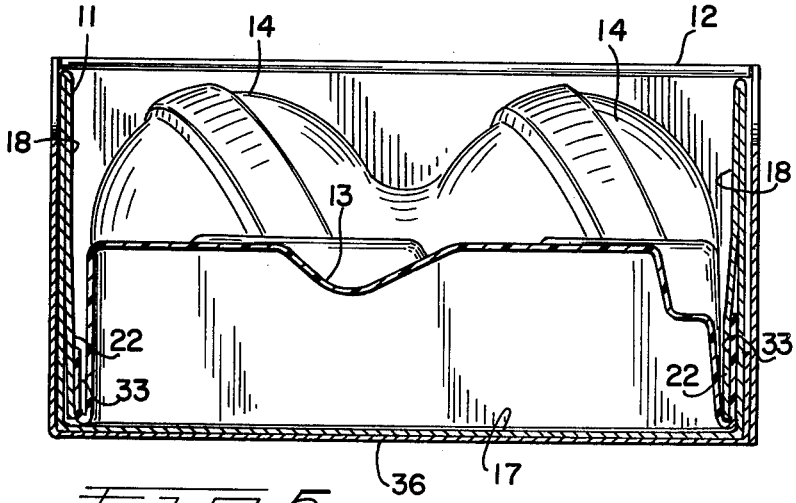
FIG. 5 is a transverse sectional view through the carton assembly taken on the line 5—5 of FIG. 2.
Figures 6, 7:
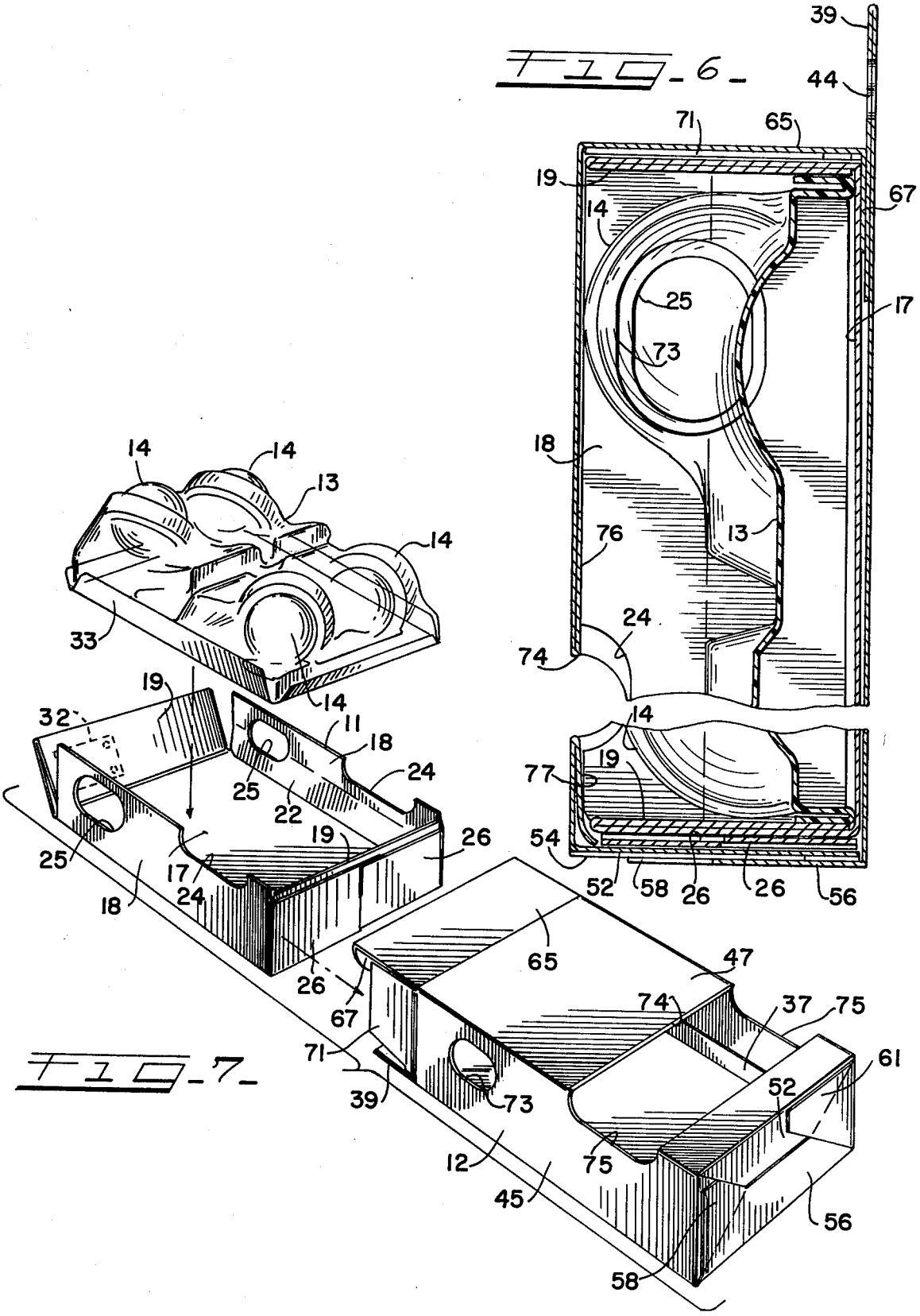
FIG. 6 is a vertical sectional view through the assembled carton elements taken on the line 6—6 of FIG. 2.
FIG. 7 is an exploded general perspective view of the three carton elements in relative positions for assembly by sliding one into the other.

The opposite end wall is provided with a punch-out template 31 defined by score line 32. This end wall is left free to hinge along fold line 29 for more readily removing the contents of the inner carton 11 when it is extracted from the outer enclosing carton 12. As seen in FIG. 7 and best illustrated in FIG. 5, it will be noted that the blister enclosure 13 is provided with an upstanding reflange 33 along each side thereof and this flange is disposed to underlie the flange 22 on the inner side of the inner carton wall 18. It is this overlying engagement of these flanges that secures the blister enclosure in the inner carton and the locking engagement may be had at either one or both sides whereby securely to hold the blister and its contents in the inner carton with the casters held in their relative positions against any possibility of displacement. The blister, as best shown in FIG. 5, is open at its back side.

Figure 8:
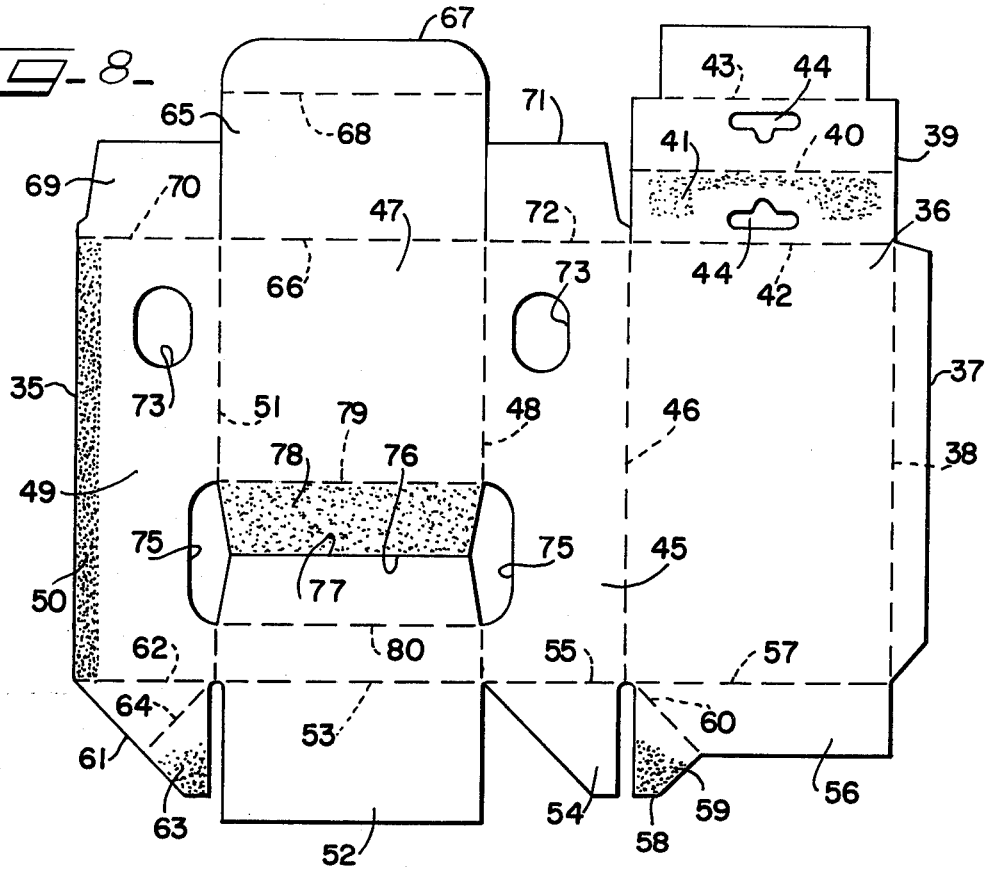
FIG. 8 is a view of the blank for the outer carton indicating the fold and score lines by dotted lines.

The outer or enclosing carton 12 is formed from a blank 35, best illustrated in FIG. 8, which is capable of being folded into a box-like container adapted fully to enclose the inner container 11 with its contents confined within the enclosure 13 in a manner whereby the inner carton may be slid into the outer carton through an opened end of the latter and removed in the same manner. The blank 35 includes a base, or back wall 36 having a sealing tab 37 extending along one side edge thereof and foldable along a fold line 38 to a position generally at a right angle to the wall 36. A tab extension 39 is provided at one end of the back wall 36, which in the final form of the carton comprises the openable end thereof and this tab-extension is foldable back upon itself along a fold line 40 to provide a double thickness. When the tab is folded back upon itself cement 41 secures the two thicknesses together and a score line 42 enables the double thickness tab to be folded to a position at an angle to the base 36, if desired. A score line 43 provides for folding of the end portion of the tab extension at the same time and position as the double thickness portion, inasmuch as the score line 43 becomes coincident with the fold line 42 when the tab extension is folded back upon itself. A T-shaped slot 44 is provided in the tab extension for hanging the completed carton for display purposes.

A side wall 45 is disposed at the opposite side of the back wall 36 from the sealing tab and is foldable along a fold line 46 to a position at substantially a right angle to the back wall. The side wall 45 joins with a front wall 47, forming the face of the completed carton, along a fold line 48 so that when the side wall 45 is folded to a position perpendicular to the back wall 36 and the front wall 47 is folded along the fold line 48 the front wall is thus disposed in spaced parallel relation to the back wall. A side wall 49, containing cement 50 along the side margin thereof, is foldable along a fold line 51 and when thus folded is disposed in position to overlie the folded tab 37 and be secured thereto by the cement 50 thereby completing a tube of rectangular section with the hanging tab 39 projecting from one end thereof.

The opposite end of the tube section is closed first by a bottom end wall member 52 on the front wall 47, which is foldable along fold line 53. A tab 54 on the side wall 45 is then folded along fold line 55 to a position overlying the end wall member 52 after which an end wall member 56 on the back wall 36 is folded along a fold line 57 to a position overlying the end member 52 and the tab 54. The member 56 includes a tab portion 58, containing cement 59, with a score line 60 joining the tab portion with the end piece 56. The tab 58 becomes coincident with the tab 54 in overlying relation therewith when they are in their folded positions and cement 59 secures them together. Finally, to complete the bottom end closure, a tab 61 on the side wall 49, where it is joined along a fold line 62, is folded over the one end of the end closure member 56 and has a cemented portion 63 which overlies the bottom end wall member 52 and is secured thereto by the cement. A diagonal score line 64 divides the cemented portion of the tab 61 from the remainder of the tab and when this is secured, as described, the bottom end closure of the outer carton 12 is completed.

At the openable end of the carton containing the tab extension 39 the carton is designed to be readily opened and closed at will and this is accomplished by an end closure member 65 hingedly connected to the front wall 47 of the carton along a fold line 66. An end tab 67 on the member 65 foldabale along a fold line 68, when folded, is adapted to be engaged into the end of the carton adjacent to the double thick end tab extension 39. An end closure tab 69 on the side wall 49 is foldable along a fold line 70 to fold inwardly over the open end of the carton and an end closure tab 71 foldable along a fold line 72 folds inwardly over the carton open end at the other side thereof. Both of these end tabs 69 and 71 are folded inwardly before the end closure member 65, which overlies the tabs 69 and 71 in the closed condition of the carton.

Each of the carton side walls 45 and 49 is provided with a window opening 73 which it will be noted in the final assembly of the inner and outer cartons 11 and 12 are aligned with the window openings 25 in the side walls of the inner carton so that in this final assembled condition with the contents in the closed package it is possible to observe the two upper casters confined by the blister 13, through the windows in the respective side walls. In the front wall 47 of the enclosing carton a relatively large window opening 74 is provided for viewing the two lowermost casters in the blister 13 and which extends into the side walls 45 as at 75. The window opening 74 at the upper and lower sides thereof is provided with tabs 76 and 77. The upper tab 76 is folded back along line 79 to provide a double thickness at the upper side of the window and is secured to the inside surface of the wall 47 by cement 78. The lower flap 77 is folded inwardly along line 80 but is not cemented to the inner face of the wall 47 and instead is folded to the inner position where it is engaged by the inner carton 11 when it is inserted into the outer carton and thus press and retain the flap 77 against the inner wall (see FIG. 6). As best indicated in FIG. 1, it will be seen that the cutouts 24 in the side walls 18 of the inner carton 11 are in alignment with the open portions 75 of the outer carton 12 so that no interference is had in viewing the contents from these angles.

MODIFIED EMBODIMENT

Figure 10:
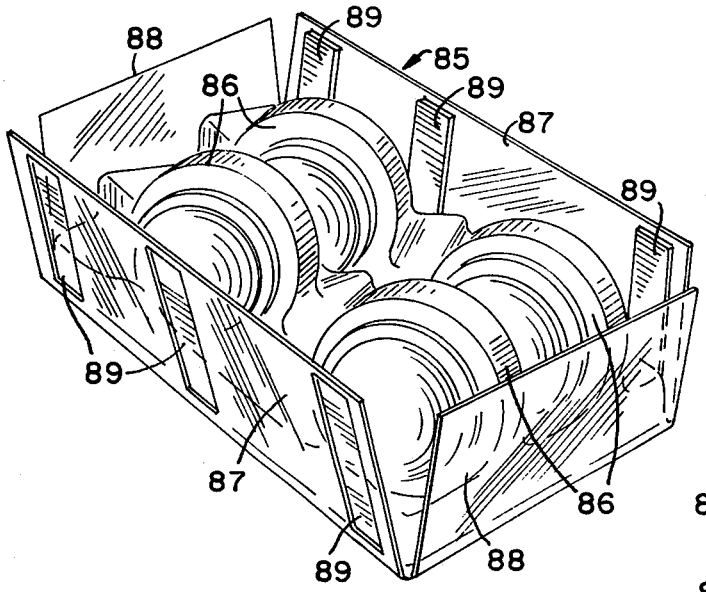
FIG. 10 is a general perspective view of a modified form of the blister element.

The version of the blister element and package enclosure outer carton, as shown in FIGS. 10 through 13, comprises a modification of the basic inventive concept, particularly with respect to the transparent blister element 85, which, as best shown in FIG. 10, retains the concept of a transparent enclosure molded and shaped to incorporate four integral compartments 86 closely conforming to the contours of these typical furniture casters of the spherical design contemplated by this invention.

The blister element 85 is designed particularly for ready insertion into the enclosure carton where it is retained primarily by frictional contact with the interior surfaces of the carton and for simple removal from the carton merely by sliding the blister through an end opening of the carton. For this purpose, the blister 85 is provided with separate side and end flanges 87 and 88 respectively, which preferably extend at least full height of the blister element and slightly in excess of the dimension between the opposing interior surfaces of the enclosing carton.

Figure 12:
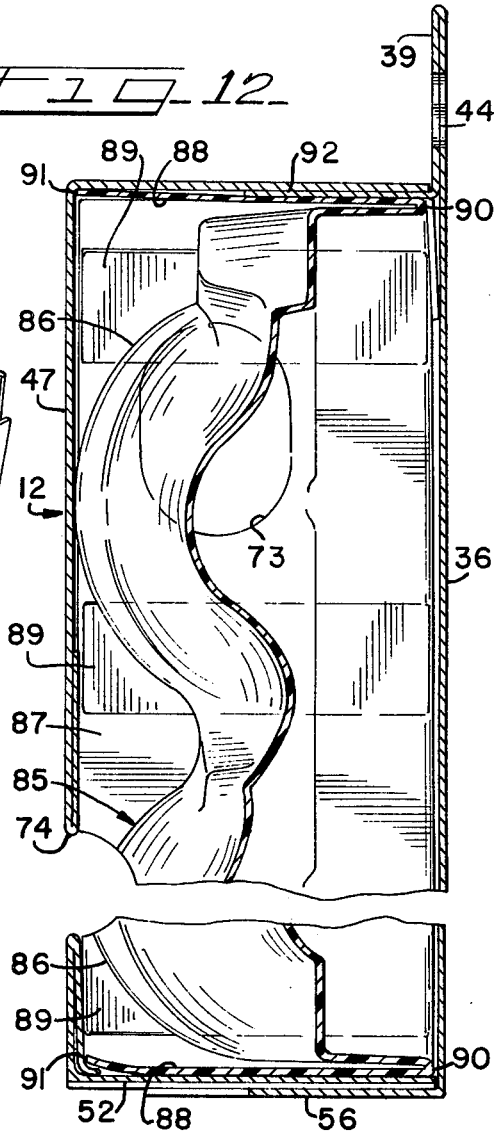
FIG. 12 is a vertical sectional view through the assembled blister element and the outer enclosure carton showing the blister with its end flanges in section, and a side flange in elevation, both in edgewise binding engagement with the interior surfaces of the carton.
Figure 13:
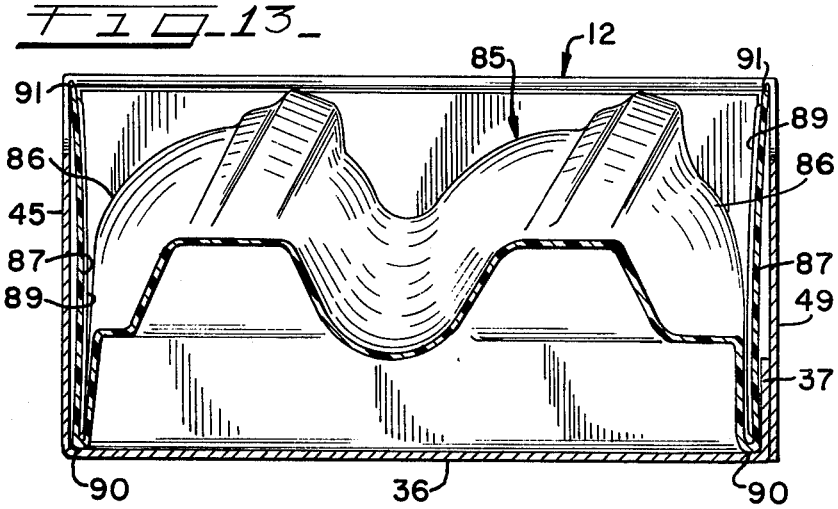
FIG. 13 is a horizontal sectional view of the assembled blister element and enclosure carton showing the side flanges of the blister, in section, and an end flange in elevation, both in edgewise frictional engagement with interior surfaces of the carton.

This is best shown in FIGS. 12 and 13, where it will be seen that the flanges 87 and 88 engage edgewise against the opposing interior walls of the carton and in fact, are actually bowed slightly by the engagement to ensure a frictional pressure contact with the carton.

Normally, this will be sufficient to retain the blister 85, with its contained casters, in the carton but will also permit of the blister and contents sliding readily into and out of the carton.

It will be noted as best revealed in FIG. 10, that the flanges 87 and 88, each being separate from all of the others, are formed to flare outwardly toward their free edges. This will have the effect of additionally pressing against other carton interior surfaces when the blister is inserted into the carton, so that the edgewise frictional contact of the flanges with the opposing carton surfaces will be supplemented by the pressure contact afforded by the flaring flanges against these additional surfaces. The side flanges 87 are reinforced and stiffened by integral embossments 89 at spaced intervals which serve to enhance the frictional contact of the flanges edgewise with the opposing carton surfaces by holding the flanges against excessive bending under compression between the carton walls.

It will be seen that the base of each flange 87, or 88, has bearing contact with an interior carton surface at one side of the carton, as at 90, while the free edge of each flange has engagement with the opposing wall surface of the carton, as at 91. Thus, the flanges are confined between the opposing surfaces to create a frictional, or gripping engagement between the carton and blister element which, of course, is supplemented by the flaring engagement of the flanges with other carton surfaces in directions generally at right angles to the direction of the edgewise engagement.

Figure 11:
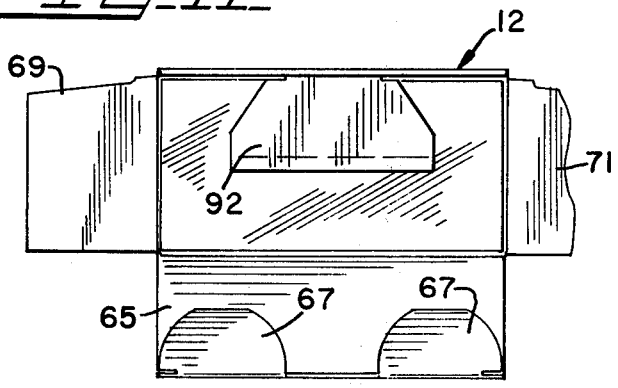
FIG. 11 is a top plan view of the outer package enclosure for the modified blister element.

The outer enclosing carton 12 of this modified version of the invention is substantially similar to that previously described. The most obvious difference between the two forms of carton resides in the provision of an integral tab 92 which overlies the end of the blister element end flange 88 when the blister is inserted in the carton enclosure and the carton is closed. This is best shown in FIGS. 11 and 12. The outer carton includes back wall 36 having a sealing tab 37 at one side which is secured by cementing to a side wall 49 (see FIG. 13). A front wall 47 connects the side walls 45 and 49 thus completing the enclosure of the carton 12 around the blister 85. The bottom of the carton is closed by an end wall member 52 and an end member 56 (see FIG. 12) similar to the structure of the outer carton shown in FIG. 7.

Just as in the previous form, the modified form of the invention also proposes to stand the carton up on its bottom end or, to suspend it for display purposes by means of a slotted tab 39, containing a slot 44 for mounting on a hook, or the like. The tab 39 comprises a double thickness folded back upon itself and the tab 92, above described, is formed integrally with this double thickness tab 39, as best indicated in FIG. 12. An end closure tab 65 is provided at the top end of the carton, which with side wall tabs 69 and 71, enable the carton to be fully closed in a manner whereby it may readily be opened for removal of the blister element 85 through this end of the carton. Tabs 67 on the end closure member 65 straddle the tab 92 in the closed position of the carton. The side walls 45 and 49 of the enclosure carton, each include an opening 73 for viewing the contents through the transparent blister element 85 holding the contents in the form of the four casters previously referred to. The two upper casters in the compartments 86 of the blister may be viewed through side wall openings 73 and a front wall opening 74 enables the two bottom casters in the compartments 86 readily to be observed.

In this form of the invention the outer carton 12 and the inner blister element 85 comprise the total enclosure for the casters which are mounted in the blister and the blister comprises the sole container for the casters in moving the contents into and out of the enclosing carton.

In practice, the blister 85 is inverted from the position illustrated in FIG. 10 when the contents are removed from the carton, so that the blister acts somewhat like a tray whereby the casters are maintained in position in their respective compartments 86 while the blister is outside the carton and when the blister is enclosed within the carton the casters are still maintained in their relative positions by the transparent compartments for viewing through the openings 73 and 74. The same procedure is followed in the insertion of the blister and contents into the carton. The blister is inverted and of course, the carton also is turned over so that when the carton is filled the blister compartments are disposed to prevent escape of the casters through the viewing openings.

From the foregoing it will readily be appreciated that the inner carton 11, of open face construction, or the blister element 85 is capable of sliding into the outer carton 12 through the open end thereof uncovered by releasing the end closure cap 65 and when thus placed in the enclosing carton and the cap closed the package securely retains its contents while enabling ready access thereto through the openable end. The contents are readily viewed in the closed carton through the side and front window openings 73 and 74 and by enclosing the contents in the blister 13, or 85, which is secured in the carton with either type, the contents is prevented from being dislodged and is maintained in originally packaged positions for full examination through the window openings. This carton assembly is especially adapted to packaging planet casters and particularly in sets of four for display purposes.

I claim:

1. A package comprised of a pair of separable box-like cartons including an inner carton and an outer enclosing carton slideable relative one to the other, said inner carton having a back wall, a bottom wall, two opposing side walls and a hinged top wall forming an open front box, said enclosing carton having front and rear walls, opposite side walls, a bottom wall and a hinged flap forming a releasable top wall, to provide an enclosing box for the inner carton, a clear plastic enclosure secured to the inner carton for covering a contents in the package, said clear plastic enclosure having an upstanding flange along each side thereof, said inner carton having a flange along the inner side of each said side walls thereof, said upstanding flange on at least one side underlying an inner carton flange to provide an interlocking engagement, the clear plastic enclosure being positively secured in the inner carton and said contents is held in relative position against displacement, an opening in the face of said enclosing carton for viewing the contents, an opening in each of said opposite side walls of the enclosing carton for viewing the contents, said inner carton having an opening in each side wall aligned with the respective openings in the opposite side walls of the enclosing carton, said contents including four separate elements, and said clear plastic enclosure being shaped to conform to separate contours of the several elements to position the elements in the package, said inner carton, said enclosing carton and said enclosure so aligned as a package that two of said elements may be viewed through said opening in the face of the enclosing carton and two of the elements may be viewed through said aligned openings in the side walls of the inner and outer cartons.

2. A packaging device comprised of an outer enclosing carton and an inner blister element slideable relative to the enclosing carton into and out of the carton, said enclosing carton having front and rear walls, opposite side walls, a bottom wall and a hinged flap comprising a releasable top wall to provide an enclosing box for said blister element, said blister element being formed from a clear plastic for covering a contents in the packaging device, an opening in the face of the carton for viewing said contents, an opening in each opposite side wall of the carton for viewing the contents, said contents including four separate articles, said blister element being shaped to conform generally to the separate contours of the four articles and positioning the several articles for viewing two of the articles through said opening in the face of the carton and two of the articles for viewing respectively through the opening in each side wall of the carton, said blister element including two side flanges extending along the side edges of element, said flanges extending the full height of the blister element and engaged edgewise with opposite internal surfaces of the enclosing carton to retain the blister element in the carton by frictional engagement, and end flanges on the blister element extending along opposite ends of the element.

3. A packaging device as set forth in claim 2 wherein said side flanges are each provided with a plurality of stiffening embossments extending substantially the full height of the flanges.

4. A packaging device as set forth in claim 3 wherein said end flanges extend the full height of the blister element, and all of said flanges flare outwardly further to engage other internal surfaces of the carton for additional frictional contact therewith.

* * * * *